US006223912B1

(12) United States Patent
Nerushai et al.

(10) Patent No.: US 6,223,912 B1
(45) Date of Patent: May 1, 2001

(54) METHOD FOR PRESENTING A PACKAGED PRODUCT ON A STAND, STAND FOR PRESENTING A PACKAGED PRODUCT AND PACKAGE FOR PRESENTING A PRODUCT ON A STAND

(76) Inventors: Sergei Alexeevich Nerushai, Ljubertsy, Komsomolsky prospekt, d.7a, kv.17, 140000, Moskovskaya oblast (RU); Nurakhmed Nurislamovich Latypov, 5 Voikovsky proezd,d.10, kv. 31, 125171, Moscow (RU)

( * ) Notice: Subject to any disclaimer, the term of this patent is extended or adjusted under 35 U.S.C. 154(b) by 0 days.

(21) Appl. No.: 09/420,580

(22) Filed: Oct. 19, 1999

(30) Foreign Application Priority Data

Nov. 3, 1998 (RU) ..... 98119707

(51) Int. Cl.[7] ..... A47F 5/00

(52) U.S. Cl. ..... 211/59.2; 211/59.3; 206/359.5; 40/538; 40/605; 312/234

(58) Field of Search ..... 211/59.2, 59.3, 211/57.1, 59.1; 206/359.5; 40/124, 538, 605; 312/234

(56) References Cited

U.S. PATENT DOCUMENTS 1,609,989 * 12/1926 Chubb .
2,898,171 * 8/1959 Ehlert et al. ..... 312/122
3,910,412 * 10/1975 Vargo ..... 206/459.5
4,255,001 * 3/1981 Frishman .
4,706,821 * 11/1987 Kohls et al. ..... 211/59.3
4,762,235 * 8/1988 Howard et al. ..... 211/59.3
4,934,076 * 6/1990 Fowler ..... 40/124 X
5,097,962 * 3/1992 Eklof et al. ..... 211/59.2
5,160,051 11/1992 Bustos .

* cited by examiner

*Primary Examiner*—Robert W. Gibson, Jr.
(74) *Attorney, Agent, or Firm*—Burns, Doane, Swecker & Mathis, L.L.P.

(57) ABSTRACT

A method for presenting a packaged product on a stand, comprising placing each product unit enclosed in a package on inclined shelves arranged on a frame of the stand, in a plurality of rows and sequentially one behind another in each row with the possibility for forward movement of each following package in the row under the effect of its own weight to the point of removal of the first package in the row by a consumer, the row being limited by a rim. The frame and shelves of the stand are used to form a three-dimensional matrix, consisting of rows, lines and columns, in accordance with which each product unit enclosed in a package is placed. Packages with an identical product are arranged in an according, designed for that package, row so that the face side of the package is disposed in a plane parallel to a plane of the face side of the stand. The face sides of the packages of the first elements of the rows form a common face surface of the stand, providing information service during selection of the goods by the consumer and/or being a billboard. A stand for presenting a packaged product comprises a frame with inclined, rimmed shelves for packages with a product secured thereon. The stand is a three-dimensional matrix consisting of rows, lines and columns, in accordance with which packages with products are laced on the stand. The face side of a package is placed in a plane parallel to the face side of the stand. The face sides of the packages of the first elements of the rows form a common face surface of the stand.

14 Claims, 4 Drawing Sheets

METHOD FOR PRESENTING A PACKAGED PRODUCT ON A STAND, STAND FOR PRESENTING A PACKAGED PRODUCT AND PACKAGE FOR PRESENTING A PRODUCT ON A STAND

FIELD OF THE INVENTION

The present invention related to light industry, and more exactly, to a method for presenting a packaged product for its realization or advertisement, a stand for presenting a packaged product and a package for presenting a product on a stand.

BACKGROUND ART

A method for presenting a packaged product on a stand is known, the method consisting of placing each product unit enclosed in a package on inclined shelves arranged on a frame of the stand, in a plurality of rows and sequentially one behind another in each row with the possibility for forward movement of each following package in the row under the effect of its own weight to the point of removal of the first package in the row by a consumer, the row being limited by a rim.

Also known is a stand for presenting a packaged product, the stand comprising a frame having inclined shelves for the packages with a product, the shelves being secured to the frame and provided with rims.

Also known is a package for presenting a product on a stand having several inclined shelves with a rim, the shelves being arranged on the frame at an angle to the face plane of the stand, the package comprising a body having face and rear walls and a base (see, for example, U.S.A. Pat. No. 5,160,051, 1992).

A drawback of the known method, stand and package should be considered to be that the packages being presented are arranged in an arbitrary order, which makes it difficult for a consumer to select different type products, since the packages with products are placed without any system and do not form a single information stand, providing a consumer with the possibility of orientation when selecting a product. Wherein, the front sides of the packages, which are arranged on the inclined shelves, are inclined, i.e. are placed at some angle to the front wall of the stand. Then, in order for the consumer to see the package, it is necessary that the stand be suspended either above the eye level of the consumer or much lower in order to see the upper parts of the packages, but this is inconvenient for arrangement of the products on the stand and for selection of a product by a consumer.

SUMMARY OF THE INVENTION

The object of the present invention is to create a method for presenting a packaged product on a stand, wherein placement of a product on a special stand with the utilization of a three-dimensional matrix, developed for a certain set of products, makes it possible to place and present the packaged product clearly, in a systematic manner, making it easier for a consumer to select the product.

Another object of the invention is to create a special stand for presenting a packaged product, the construction of which stand makes it possible to place a product on the special stand with the utilization of a three-dimensional matrix, developed for a certain set of products, to present the packaged product clearly, in a systematic manner, and to make it easier for a consumer to select the product.

Another object at the base of the present invention is to create a package for presenting a product on a stand, the construction of which makes it possible to place the product on a special stand with the utilization of a three-dimensional matrix, developed for a certain set of products, to present a packaged product clearly, in a systematic manner, and to make it easier for a consumer to select a product.

The stated object is attained in a method for presenting a packaged product on a stand, comprising placing each product unit enclosed in a package on inclined shelves arranged on a frame of a stand, in a plurality of rows and sequentially one behind another in each row with the possibility for forward movement of each following package in the row under the effect of its own weight at the point of removal of the first package in the row by a consumer, the row being limited by a rim, in that in accordance with the invention, the frame and shelves of the stand are used to form a three-dimensional matrix, consisting of rows, lines and columns, in accordance with which each product unit is placed, the product unit being enclosed in a package, packages with an identical product are arranged in an according, designed for that package, row so that the face side of the package is disposed in a plane parallel to a plane of the face side of the stand, wherein the face sides of the packages of the first elements of the rows form a common face surface of the stand, providing information service during selection of the goods by the consumer and/or being a billboard. The aforesaid makes it possible for a consumer to see a single large pattern or image on the face surface of the stand from afar.

It is advisable that the face surface of the rims of all of the shelves be located in a plane coinciding with the common face surface of the stand.

It is useful that liquid, solid and granular products be used as the packaged product.

It is advantageous that products selected from the group consisting of alcoholic and nonalcoholic beverages, milk products, perfume products, toilet and hygienic liquids, be used as the liquid products.

It is also useful that packaged perfume be presented as the perfume products, wherein a map of perfume odors and/or a billboard is formed on the face surface of the stand as the image.

It is also advisable that alcoholic beverages be presented as the packaged product, wherein a geographical map or map of wines be used as the image on the face surface of the stand.

It is also advantageous that when a milk product is presented, a map of the fat content of the milk product and the supplements be used as the image on the face surface of the stand.

It is also useful that depending on the product being presented, coordinates selected from the group consisting of "hot-cold," "sour-sweet," "male-female," "flower-tree," "alcoholic-nonalcoholic," "fire-water," "earth-air," be used as coordinates of the image on the face surface of the stand, formed from lines and columns of packaged products.

It is also advantageous that in order to exactly position the packages on the stand, the numbers of the lines and columns be put on the face side of the packages.

The stated object is also attained in a method for presenting a packaged product on a stand, comprising placing each product unit enclosed in a package on shelves arranged on a frame of a stand, in a plurality of rows and sequentially one behind another in each row with the possibility for forward movement of each package following in the row under the effect of its own weight to the point of removal of the first package in the row by a consumer, the row being limited by a rim, in that in accordance with the invention, the frame and shelves of the stand are used to form a three-dimensional matrix, consisting of rows, lines and columns, in accordance with which each product unit enclosed in a package is placed, packages with an identical product are arranged in an according, designed for that package, row so that the face side of the package is disposed in a plane parallel to a plane of the face side of the stand, wherein the face sides of the packages of the first elements of the rows form a common face surface of the stand, providing information service during selection of the goods by the consumer and/or being a billboard.

The stated object is also attained in that a stand for presenting a packaged product, comprising a frame with inclined, rimmed shelves secured thereon for packages with a product, in accordance with the invention, is a three-dimensional matrix consisting of rows, lines and columns, in accordance with which packages with products are placed on the stand, wherein packages with an identical product are arranged on a shelf in an appropriate row to the depth of the stand, and the face side of the package is placed in a plane parallel to the plane of the face side of the stand, while the face sides of the packages of the first elements of the rows form a general face surface of the stand, providing information service in the selection of goods by a user and/or being a billboard, wherein the angle of inclination of the face side of the package relative to its base together with the angle of inclination of the shelf is approximately 90 angular degrees.

It is advisable that the shelves be made with guides to form rows for the packages with the product, the guides being positioned parallel to each other.

The stated object is also attained in a package for presenting a product on a stand having several inclined, rimmed shelves that are placed on the frame at an angle to the face plane of the stand, the package comprising a frame having face and rear walls and a base, in accordance with the invention, the face wall or its portion is positioned at an angle to the base, wherein the angle of inclination of the face side of the package relative to its base together with the angle of inclination of the shelf is approximately 90 angular degrees.

It is advisable that the face wall has a common rib with the rear wall.

It is useful that means for taking a package by hand be placed directly adjacent the common rib.

It is advantageous that a package comprise side walls to form a sealed package for liquid products.

It is also useful that the frame be made from a material selected from the group consisting of glass, cardboard, a polymeric material, metal.

BRIEF DESCRIPTION OF THE DRAWINGS

Further, the invention will be explained by a description of a preferable embodiment with references to the accompanying drawings, in which.

DETAILED DESCRIPTION OF THE PREFERRED EMBODIMENTS

A stand for presenting a packaged product comprises a frame 1 (FIG. 1) with inclined shelves 2 for packages 4 with products, the shelves having rims 3 and being secured on the frame.

Figure 2:
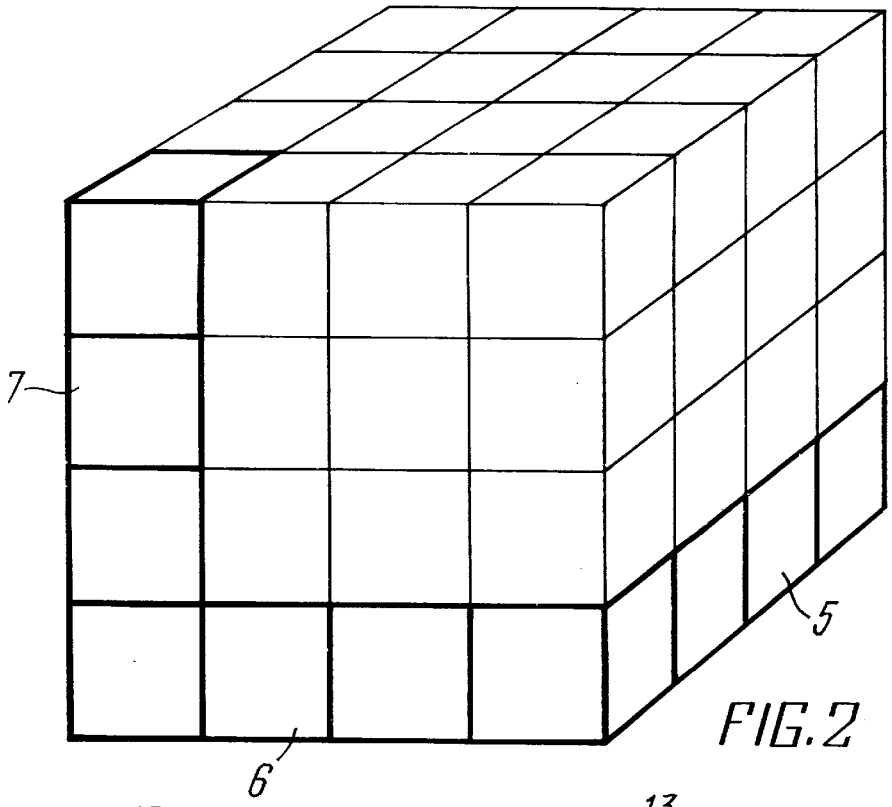
FIG. 2 shows a three-dimensional matrix consisting of rows, lines and columns, in accordance with the invention.

The stand is a three-dimensional matrix consisting of rows 5 (FIG. 2), lines 6 and columns 7, in accordance with which packages 4 with products are arranged on the stand.

Figure 3:
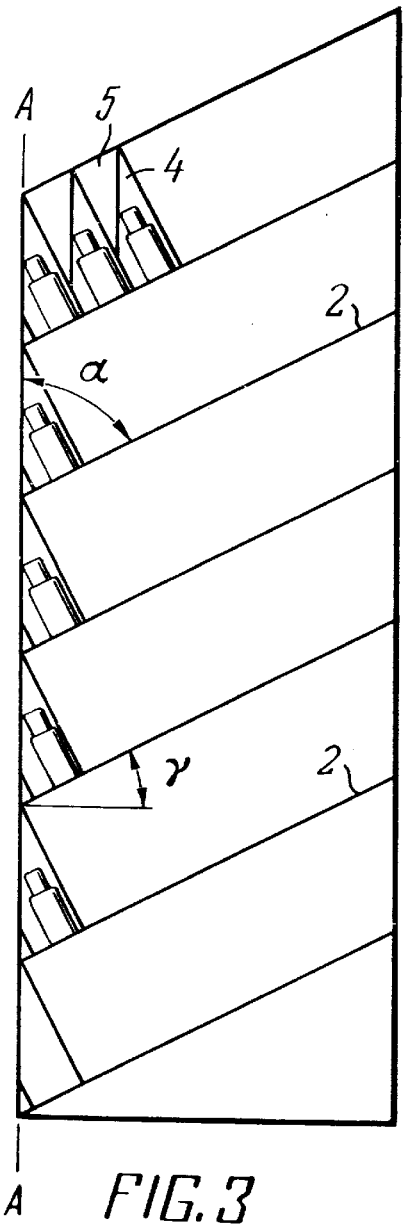
FIG. 3 shows a side view of the stand with inclined shelves, in accordance with the invention.

Wherewith, packages 4 with an identical product are arranged in the stand on a shelf 2 in a corresponding row 5 through the depth of the stand, and the face side of the package is placed in plane A—A (FIG. 3), parallel to the plane of the face side of the stand.

Figure 4:
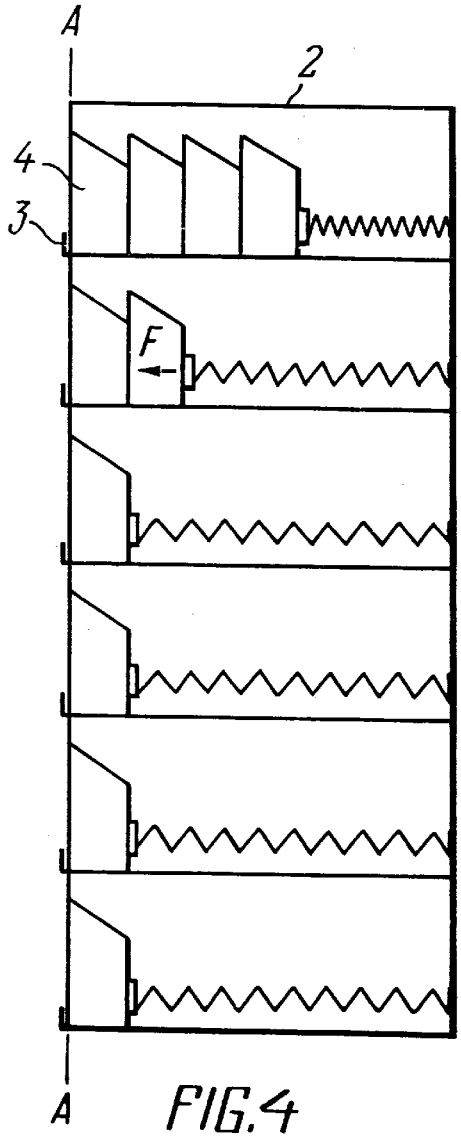
FIG. 4 shows a side view of the stand with horizontal shelves, in accordance with the invention.

In another embodiment, the angle of inclination of the shelf 2 (FIG. 4) is zero degrees, i.e. the shelf is placed horizontally.

The face sides of the packages 4 (FIG. 1) of the first elements of rows 5 form a common face surface of the stand, which provides information service when goods are being selected by a consumer and/or serves as a billboard.

The angle $\alpha$ (FIG. 3) of inclination of the face side of the package 4 relative to its base together with the angle $\gamma$ of inclination of the shelf 2 is approximately 90 angular degrees.

The shelves 2 are made with guides 8 (FIG. 1) to form rows 5 for packages 4 with a product, the guides being positioned parallel to one another.

Figure 5:
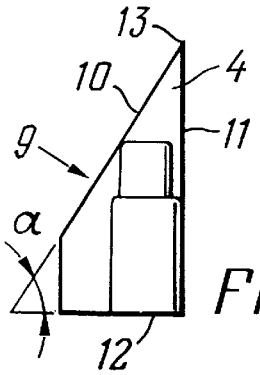
FIG. 5 shows a side view of the package with a product arranged therein, for example, a bottle of perfume, in accordance with the invention.

The package 4 (FIG. 5) for presenting a product on a stand comprises a body 9, having a face wall 10, a rear wall 11 and a base 12. The face wall 10 or a part thereof is positioned at an angle $\alpha$ to the base 12, wherewith the angle of inclination of the face side of the package relative to its base together with the angle of inclination of the shelf is approximately 90 angular degrees., The face wall 10 has a rib 13 which is common with the rear wall 11.

Figure 6:
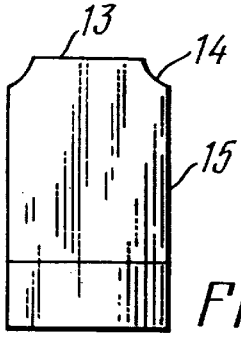
FIG. 6 shows a front view of the package without symbolics applied thereon, in accordance with the invention, with recesses for fingers, in accordance with the invention.

A means 14 for manually grasping the package is placed directly adjacent the common rib 13 (FIG. 6). In this embodiment the means is two recesses.

In order to form a sealed package for liquid products, the package is provided with side walls 15.

The body of the package 4 is made of a material selected from a group consisting of glass, cardboard, a polymeric material, metal.

The method for presenting a packaged product on a stand is carried out in the following manner.

Each product unit enclosed in a package 4 (FIG. 3) is placed on inclined shelves 2 arranged on a frame 1 of a stand, in a plurality of rows 5 and sequentially one behind another in each row with the possibility for forward movement of each following package 4 in the row under the effect of its own weight to the point of removal of the first package in the row 5 by a consumer, the row being limited by a rim 8.

The frame 1 and the shelves 2 of the stand are used to form a three-dimensional matrix consisting of rows 5, lines 6 and columns 7, in accordance with which each product unit enclosed in a package 4 is placed.

Packages 4 with an identical product are arranged in an according, designed for that package, row 5 so that the face side of the package is disposed in a plane A—A parallel to a plane of the face side of the stand.

The face sides of the packages 4 of the first elements of the rows 5 form a common face surface of the stand, providing information service during selection of the goods by a consumer and/or being a billboard.

The face surface of the rims 3 of all of the shelves 2 is located in a plane coinciding with the common face surface of the stand.

Liquid, solid and granular products are used as the packaged product.

Products selected from the group consisting of alcoholic and nonalcoholic beverages, milk products, perfume products, toilet and hygienic liquids, are used as the liquid products.

Packaged perfumes are presented as the perfume products, wherein a map of perfume scents and/or a billboard is formed as the image on the face surface of the stand.

Alcoholic beverages are presented as the packaged products, wherein a geographical map or map of wines is used as the image on the face surface of the stand.

When a milk product is presented, a map of the fat content of the milk product and the supplements is used as the image on the face surface of the stand.

Depending on the product being presented, coordinates selected from the group consisting of "hot-cold," "sour-sweet," "male-female," "flower-tree," alcoholic-nonalcoholic, "fire-water," "earth-air," are used as coordinates of the image on the face surface of the stand, formed from lines and columns of packaged products.

In order to exactly position a package on the stand, the numbers of the lines and columns are put on the face side of the package.

Special signs and/or images on the face side of the package in combination form an integer, i.e. after all the front packages 4 in the rows 5 will be arranged on the shelves 2. Such an integer may be, for example, a geographical map of Russia, France, the U.S.A., etc. or a generally accepted image of a map of perfumes, or the numbers of a flat matrix (FIG. 1) may be used as signs:

11 12 13 14 15 16

21 22 23 24 25 26

61 62 63 64 65 66.

Figure 7:
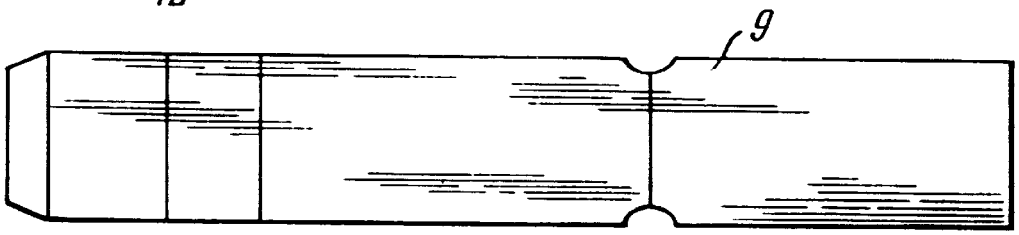
FIG. 7 shows the development of a package for a product, in accordance with the invention.

The package 4 (FIG. 5) for a product, for example, for a perfume bottle, is made with an inclined face, wherein either the whole wall 10 or only its upper part may be inclined so that the perfume bottle would fit therein. The package 4 is made up of a cardboard blank (FIG. 7).

Figure 1:
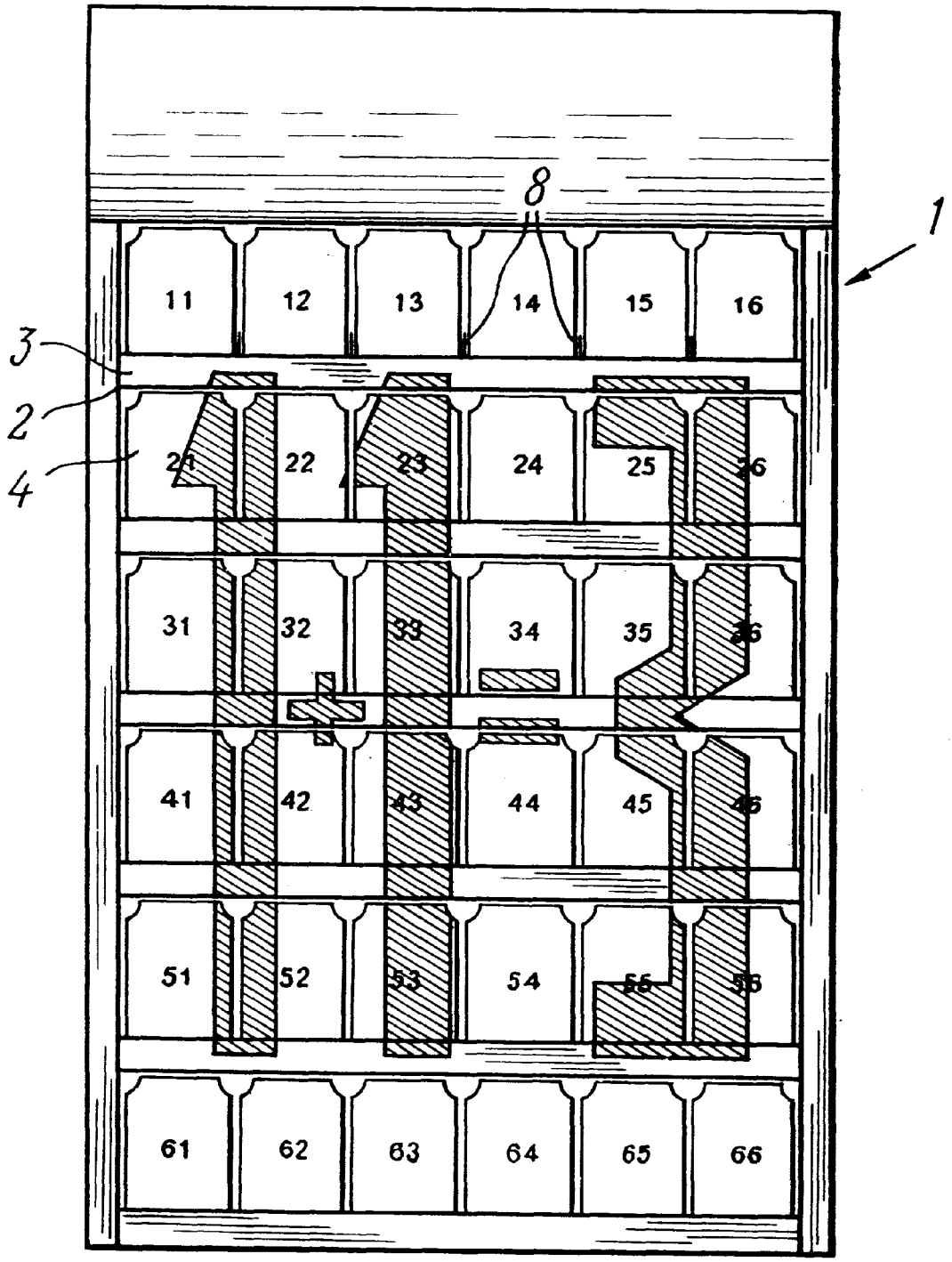
FIG. 1 shows and with packages arranged thereon in a definite order, (front view), in accordance with the invention.

Typographically, or by any other means, a sign in accordance with the chosen concept for an integer is applied on the inclined face side of the package 4 or on its upper part. This may be the number of a flat matrix (FIG. 1).

A certain product with certain properties corresponds to each concrete number of the matrix. If this is a bottle with perfume, then bottles of perfume with different scents are placed in the packages. Perfume bottles with a delicate flower scent are placed in a package 4 under the number "11." Bottles of perfume with scents gradually passing from flower scents in accordance with the map of perfumes are placed in packages with larger numbers from "12" to "16." Similarly, in the vertical rows with numbers, for example, "11 12–61," scents from delicate pass to sharper. Fragments of an integer image may, for example, be presented on the packages. These fragments, when the packages are set in place make up an image in accordance with a mosaic principle (cross-word puzzle). Fragments of the images may be of any kind, for example, different colors of the rainbow which are positioned in sequential arrangement of the colors in the rainbow itself.

The first packages 4 in the rows 5 are positioned in such a manner, that their face walls or parts thereof (in this case, the upper inclined parts) will be in the plane A—A. In combination, when all of the packages 4 are put in place, the front side of the frame 1 will be a flat matrix (FIG. 1). When a consumer or advertiser takes one of the packages 4 from any row 5, he accordingly frees a place for the package following in that row. The package 4 next in the row 5, under the effect of its own weight, sliding along the inclined shelf 3 (FIG. 4), or under the effect of a pressing force of, for example, a spring, moves toward the face surface of the stand and occupies the place of the removed package, maintaining the same image which is on the front side 3 of the frame 1. Such an execution of the stand and the packages 4 makes it possible for a consumer to orient himself/herself more easily in widely differing products, and also makes it possible to arrange the stand with packages at eye level of a consumer, which enhances the convenience of using the stand, both by a consumer and by a producer when it is being used.

Figure 8:
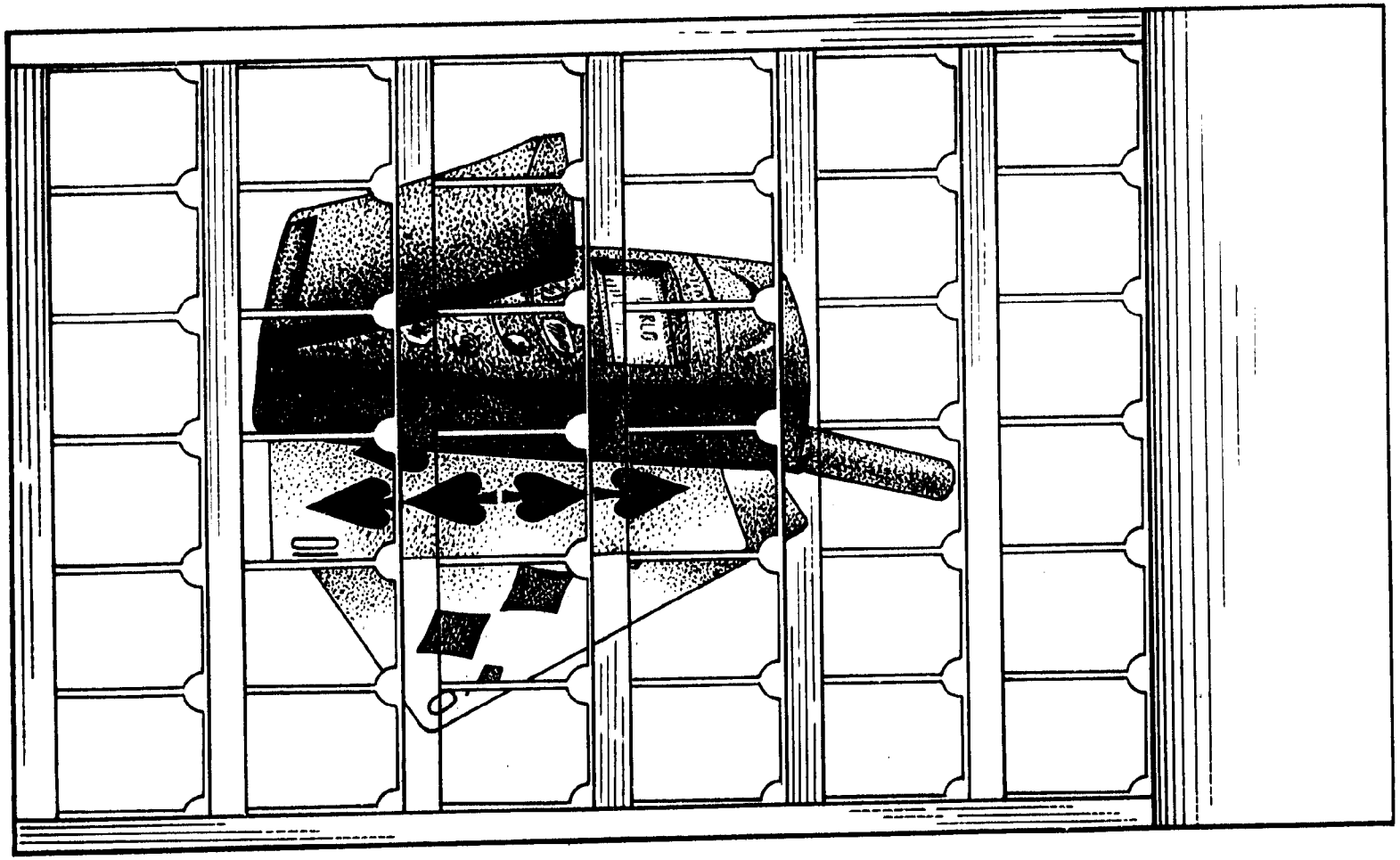
FIG. 8 shows a stand (front view) serving as an advertising poster, in accordance with the invention.

Furthermore, the large common pattern on the face surface of the stand will be seen from afar and will draw the attention of buyers. Actually, this stand is for presenting products and simultaneously is an advertising poster for the goods being sold or for a trade name, seen from afar. There is no need to search for a separate place in a store for advertisements. For example, a variant is shown in FIG. 1 when an image of the trademark "1+1=3" is presented on the face surface, and in FIG. 8 a variant where the face surface of the stand serves as an advertising poster.

What is claimed is:

1. A method for presenting a packaged product on a stand comprising:

placing each packaged product on inclined shelves arranged on a frame of a stand, in a plurality of rows and sequentially one behind another in each row with the possibility for forward movement of each following packaged product in the row under the effect of its own weight at the point of removal of the first packaged product in the row by a consumer, the row being limited by a rim, the rim having a face surface, using the frame and inclined shelves of the stand to form a three-dimensional matrix, consisting of rows, lines and columns, in accordance with which each packaged product is placed, the packaged product being enclosed in a package, arranging packages with identical packaged products according, to the package, so that a face side of the package is disposed in a plane parallel to a plane of a face side of the stand, wherein the face sides of the packages of the first packaged products of the rows form a common face surface of the stand, providing information service during selection of goods by the consumer in the form of an image.

2. A method according to claim 1, wherein the face surface of the rims of all of the shelves is located in a plane coinciding with the common face surface of the stand.

3. A method according to claim 1, wherein liquid, solid and granular products are used as the packaged product.

4. A method according to claim 1, wherein products selected from the group consisting of alcoholic and nonalcoholic beverages, milk products, perfume products, and toilet and hygienic liquids are used as the liquid products.

5. A method according to claim 1, wherein perfumes are presented as the packaged product, and a map of perfume scents is used as the image on the face surface of the stand.

6. A method according to claim 1, wherein alcoholic beverages are presented as the packaged product, and a geographical map of an area of origin of wines is used as the image on the face surface of the stand.

7. A method according to claim 1, wherein a milk product is presented as the packaged product, and a chart containing nutritional information pertaining to the milk product is used as the image on the face surface of the stand.

8. A method according to claim 1, wherein indicia selected from the group consisting of "hot-cold," "sour-sweet," "male-female," "flower-tree," "alcoholic-nonalcoholic," "fire-water," and "earth-air" are used as coordinates of the image formed from lines and columns of packaged products on the face surface of the stand.

9. A method according to claim 1, wherein the numbers of the lines and columns are put on the face side of the packaged product to provide exact positioning in the stand.

10. A method for presenting a packaged product on a stand comprising:

placing each packaged product on shelves arranged on a frame of a stand, in a plurality of rows and sequentially one behind another in each row with the possibility for forward movement of each packaged product following in the row to the point of removal of the first package in the row by a consumer, the row being limited by a rim, using the frame and shelves of the stand to form a three-dimensional matrix, consisting of rows, lines and columns, in accordance with which each packaged product is placed, the packaged product being enclosed in a package, arranging packages with identical packaged products according to the package so that a face side of the package is disposed in a plane parallel to a plane of a face side of the stand, wherein the face sides of the packages of the first packaged products of the rows form a common face surface of the stand, providing information service during selection of goods by the consumer in the form of an image.

11. A stand for presenting a packaged product comprising:

a frame with inclined, rimmed shelves for packages with a product secured thereon, a three-dimensional matrix configuration consisting of rows, lines and columns, in accordance with which packages with products are placed on the stand, wherein packages with an identical product are arranged on a shelf in an appropriate row to the depth of the stand, and the face side of the package is placed in a plane parallel to the plane of the face side of the stand, the face sides of the packages of a first element in the rows form a general face surface of the stand, providing service in the selection of goods by a user as a billboard, wherein an angle of inclination of the face side of the package relative to a base side of the package together with an angle of inclination of the shelf is approximately 90 angular degrees.

12. A stand according to claim 11, wherein the shelves include guide means to form rows for the packaged products, the guides means being positioned parallel to each other.

13. method for presenting packaged products on a stand comprising:

placing each of the packaged products on a plurality of shelves arranged on a frame of the stand;

sequentially arranging each of the packaged products in a plurality of rows so that forward movement of each of the packaged products in the respective rows is enabled upon removal of each product from the stand by a consumer, while limiting the forward movement of each remaining packaged products within the stand;

defining a three-dimensional matrix configuration of packaged products within the frame and shelves, the configuration consisting of rows, lines and columns for placement of each packaged product;

arranging each packaged product according to the contents therein; and arranging the face side of the packaged product to be displayed in a plane parallel to a face side of the stand, wherein the face side of each packaged product in a row is identical, so that when each packaged product is placed in a specified row, line and column on the frame of the stand the face side of the packaged products combine to form a visually common front surface of the stand, which provides information in the form of an image during the selection of goods from the stand by the consumer.

14. A method according to claim 13, wherein the shelves are inclined to allow gravity fed forward movement of the packaged products in the respective rows upon removal of each product from the stand by the consumer.

* * * * *